United States Patent [19]

Waters

[11] 4,399,318

[45] Aug. 16, 1983

[54] EMI SHIELDING ENCLOSURE FOR A CABLE CONNECTOR

[75] Inventor: Edwin R. Waters, Sidney, N.Y.

[73] Assignee: The Bendix Corporation, Southfield, Mich.

[21] Appl. No.: 329,153

[22] Filed: Dec. 10, 1981

[51] Int. Cl.[3] ..... H01R 13/658

[52] U.S. Cl. ..... 174/35 C; 339/143 R

[58] Field of Search ..... 174/35 C, 76, 75 C, 174/75 R, 89; 339/143 R, 218 R, 218 M

[56] References Cited

U.S. PATENT DOCUMENTS

| | | | |
|---|---|---|---|
| 3,643,208 | 2/1972 | Massa, Jr. | 339/143 R X |
| 3,990,765 | 11/1976 | Hill | 339/143 R X |
| 4,025,145 | 5/1977 | Shaffer et al. | 339/143 R |

*Primary Examiner*—A. T. Grimley
*Assistant Examiner*—D. A. Tone
*Attorney, Agent, or Firm*—Russel C. Wells; R. J. Eifler

[57] ABSTRACT

An EMI shielding enclosure for a cable connector is formed of aluminum and has an aperture 44 therein to receive potting compound 46 to secure the wires 28 to the connector body. The braided inner cover 26 of the cable 24 is formed into a pig tail 34 and is secured in the back-shell 40 by the potting compound 46. The outer braided cover 30 of the cable, which is the braided shield, is also terminated in a pig tail 36 which is folded back on itself and through the end plate or strain relief means 38 of the enclosure. The strain relief means 38 is welded 42 to the back-shell 40 and a rivet 48 plugs the potting aperture 44 in the back-shell 40 after which a rubberized boot 50 is formed over the enclosure. Prior to forming the boot 50, the back-shell 40 is staked or secured to the connector body. The result is a solid, secure EMI shielded enclosure for a cable connector and operates with either a straight or elbow back-shell 40.

4 Claims, 2 Drawing Figures

EMI SHIELDING ENCLOSURE FOR A CABLE CONNECTOR

The invention relates to electrical cable connection and more particularly to electro magnetic interference shielding (EMI) for cable connectors.

In many electronic assembly applications, there is a demand for stringent shielding of electrical circuits, in particular with the wiring associated with such circuits while simultaneously protecting the wiring from being cut. In addition, in most assemblies the space available around the assemblies for connection of cables is at a minimum and therefore the connector and cable assembly must be such as to maintain smallest practicable size while maintaining good electrical contact and good support to prevent breakage of the wires from handling or vibration.

In the assembly of connectors to cables, it is necessary to store on the cable the housing for the connector, which is commonly called the "back-shell", as well as any strain relief means prior to the time of connecting the several contacts to the end of the wires of the cable. When the several contacts are connected to the cables and inserted into the connector body, the back-shell is brought forward and is secured to the connector body. The strain relief means is clamped onto the cable and to the back-shell to secure the cable. Various methods and devices have been used to accomplish this, but the problem faced in this instance is that the size of the shielding wire for the cable is much heavier than normally dealt with thereby requiring a different approach.

In order to solve the problem of providing electromagnetic radiation shielding and to secure the cable shielding and wires to the connector body, the present invention resulted. In order to reduce cost, the back-shell of the present invention is fabricated from aluminum which can be either machined or when production quantities become sufficient can be formed by means of a drawing process. The strain relief means also functions as part of the back-shell and works not only to clamp the cable to prevent it from being pulled out of the back-shell but also provides an enclosure for EMI shielding and a means for grounding the cable shielding. Further the back-shell has been provided with an access aperture or fill-hole to permit a potting compound to be inserted into the back-shell thereby acting to secure the cable to the connector body, to secure or retain the cable within the connector and further to immobilize the wiring to minimize breakage due to vibration.

In particular it is an advantage of the present invention, when working with a cable that has at least one braided cover overlying the jacketed wires of the cable which functions to protect the cable from other environmental conditions such as oil, grease and a second braided cover overlying the first which is a heavy weight metallic shield that is used to prevent EMI radiation, and to provide more abrasion resistance so that the cable is not damaged, to use the EMI shielding enclosure described and claimed herein.

These and other advantages are evident from the following detailed description.

DETAILED DESCRIPTION

Figure 1:
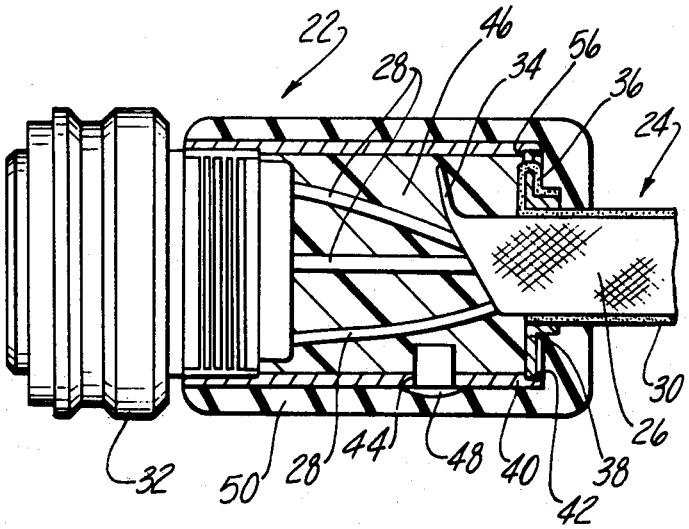
FIG. 1 is a plan view, partially in section, of the present invention.

In referring to the FIGS. by the characters of reference, FIG. 1 is a preferred embodiment of the present invention wherein the connector assembly 22 is illustrated. Connected to the connector assembly 22 is a cable 24 having an abrasive resistant, oil resistant, cover 26 overlying the jacketed wires 28 and further an electromagnetic shielding braid 30 overlying the cover 26. In the connector 22 of FIG. 1 there is illustrated a conventional external ring means 32 which is used to secure the cable mounted connector body to the stationary or panel mounted connector portion of the assembly. As is well known, the ring means 32 typically is internally threaded so as to mate and bring the two connectors together. The connector body, which is not shown, is a conventional connector body wherein the wires 28 of the cable 24 are secured to pins in the connector body by soldering or in the alternative the connector pins are previously crimped to the ends of the wire and they are then inserted into the body.

As illustrated in FIG. 1 the cable comprises a first cover 26 which overlies several individually jacketed wires 28 of the cable 24 of which three wires 28 are illustrated. This cover 26 which is typically non-metallic and is used to protect the cable both from environmental conditions such as oil and grease and from the sharp corners on assemblies which will cut or damage the jacketed wires 28 and to protect the jacketed wires 28 from the second cover 30. In the preferred embodiment the cover 26 is formed by braiding polytetrafluorethylene coated fiberglass thread around the jacketed wires 28. Overlying the first cover 26 is a second cover or an electro-magnetic shield, which is typically braided wire which may be very light weight plated copper wire of four or five thousandths inches (0.1016 mm or 0.127 mm) in diameter or as in the present embodiment may be nickel wire of eight thousandths inches (0.2032 mm) in diameter.

As illustrated in FIG. 1 the first cover 26 is terminated in a braiding tail or pig tail 34. The braided tail 34 of the first cover 26 helps hold the cable 24 to the connector 22 so that the jacketed wires 28 are not broken when the connector is removed. The second cover 30 is also terminated in a braided tail or pig tail 36 and is formed back on itself through the strain relief means or ferrule 38 such as to retain the cable 24 in the connector.

The back-shell 40 of the connector is placed over the connector body assembly in a press fit condition and in the preferred embodiment is then staked to further secure it to the connector body. The strain relief means 38 is then inserted into the end of the back-shell 40 and welded or staked 42 in place thereby providing an integral assembly with the connector and provides an electrical connection from the metallic shield 30 to the back-shell 40. An aperture 44 is provided in the back-shell 40 through which a potting compound 46 is inserted into the interior portion of the back-shell 40. The purpose of the potting compound 46 is not only to secure the wires 28 into the connector but it also adheres to and secures the braided tail 34 of the first cover 26 and retains it in place. After the potting compound 46 is inserted into the back shell 40 the aperture 44 is sealed or closed by a means 48 such as a rivet fabricated from the same material as the backshell. Next, the complete back-shell assembly is encased or moulded in a rubber-like compound 50 such as Viton rubber, to immobilize the cable 24 to resist vibration fatigue.

Figure 2:
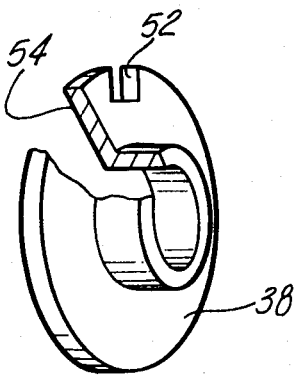
FIG. 2 is a perspective view, partially broken away, illustrating one form of the strain relief means of FIG. 1.

As illustrated in FIG. 2 the strain relief means 38 is adapted to encircle the cable 24 and to provide a receptable means 52 for the braided tail 36 of the second or outer-most cover 30 of the cable. During the assembly of the cable 24 to the connector this strain relief means 38 is placed on the cable and stored thereon until the cable is assembled to the connector. As illustrated in FIG. 2 the receptable means 52 is a slot for receiving the braided tail 36 of the second cover 30. The braided tail 36 of the cover is passed behind or along the inside surface 54 of the strain relief means 38 and through the slot means 52 such that the braided tail 36 is mechanically secured to the strain relief means 38. When the connector is fully assembled and potted, the potting assists in retaining and securing the braided tail in the connector and the slot 52. In addition, the slot 52 is so designed that there is an interference fit between the braided tail 36 and the walls of the slot and the slot cooperates with the back-shell 40 to secure the braided tail in place so that it can not be pulled out and further to provide an electrically conductive connection.

As previously indicated, once the cable 24 is secured to the connector body, the strain relief means 38 is fastened to the back-shell 40 by fastening method such as welding, brazing or staking 42. Next, the overall assembly is then potted and encapsulated with a rubber moulding or boot 50 which encloses the back-shell 40, the aperture closing means 48 and the strain relief means 38, further securing the cable 24 from vibration fatigue.

In the preferred embodiment, the back-shell 40, the strain relief means 38 and the aperture closing means 48 are all formed out of aluminum. It is not only a lightweight material, but is an effective EMI shield as well as being easy to manufacture. By having the strain relief means 38 a separate part and welded to the back-shell 40 the back-shell can be a cylindrical member opened at either end with a shoulder 56 in one end to receive and locate the strain relief means 38 prior to welding. The other end of the back-shell 40 is positioned on the connector in an interference fit and is secured by means of staking, welding or some other means of fastening. The important thing is that the back-shell 40 becomes an integral part of the connector and is not loose. In addition by being an open cylindrical member the back-shell 40 is easily stored upon on the cable 24 during assembly.

It is to be understood that while FIG. 1 illustrates a straight back-shell, the present invention is also applicable to a 90° back-shell. The strength of the connection of the cable 24 to the housing and the completeness of the EMI shielding makes such a 90° back-shell very practical in close areas.

I claim:

1. An EMI shielded connector assembly comprising a cable connector body, a cable having at least a first cover overlying jacketed wires, a second braided cover overlying the first cover, the cable having the jacketed wires therein extending beyond the first and second covers and inserted in the connector body, each of the first and second covers terminating in respective tails; and an aliminum back-shell receiving the cable at one end and press fit to the connector body at the other end, the back-shell having an aperture therein adapted to receive potting compound within the shell; said assembly characterized by:

first means encircling the cable and having a slot means therein receiving and securing the tail of the second braided cover;

second means securing said first means to the back-shell;

potting compound filling the interior of the back-shell and securing the tail of the first cover and the jackets of the wires therein; and means comprised of aluminum closing the aperture and with the back-shell and said first means forming an EMI shield over the cable and connector body.

2. An EMI shielded connector assembly according to claim 1 additionally including a molded rubber boot encapsulating said back-shell and said closing means; said boot sealingly encircling said cable where it is received in said first means.

3. An EMI shielded connector assembly according to claim 1 or 2 wherein said first cover is formed by braiding polytetrafluoroethylene coated fiberglass thread around said jacketed wires and terminating said first cover in a braided tail.

4. An EMI shielded connector assembly according to claim 3 wherein said second cover is formed by braiding nickel wire around said first cover and terminating said second cover in a braided tail.

* * * * *